US005823423A

United States Patent [19]

Murray

[11] Patent Number: 5,823,423

[45] Date of Patent: Oct. 20, 1998

[54] ENVELOPE

[76] Inventor: Thomas Murray, 28 Patrician Villas, Stillorgan, County Dublin, Ireland

[21] Appl. No.: 827,779

[22] Filed: Apr. 11, 1997

Related U.S. Application Data

[63] Continuation of Ser. No. 681,608, Jul. 29, 1996, abandoned, which is a continuation of Ser. No. 543,494, Oct. 16, 1995, abandoned, which is a continuation of Ser. No. 211,096, Mar. 18, 1994, abandoned.

[30] Foreign Application Priority Data

| | | | |
|---|---|---|---|
| Sep. 23, 1991 | [IE] | Ireland | 3334/91 |
| Oct. 9, 1991 | [IE] | Ireland | 3518/91 |
| Apr. 15, 1992 | [IE] | Ireland | 921213 |

[51] Int. Cl.[6] ..... B65D 27/04; B65D 27/06

[52] U.S. Cl. ..... 229/303; 229/71; 229/316

[58] Field of Search ..... 221/71, 302, 303, 221/305, 306, 313, 316

[56] References Cited

U.S. PATENT DOCUMENTS

| | | | |
|---|---|---|---|
| 3,227,360 | 1/1966 | Krueger | 229/303 |
| 3,498,528 | 3/1970 | Klein | 229/302 |
| 3,747,837 | 7/1973 | Wilson | 229/303 |
| 4,354,631 | 10/1982 | Stevenson . | |
| 4,775,095 | 10/1988 | Emmott | 229/303 |

FOREIGN PATENT DOCUMENTS

| | | |
|---|---|---|
| 2 542 704 | 9/1984 | France . |
| 212712 | 4/1924 | United Kingdom . |
| 2 117 319 | 10/1983 | United Kingdom . |

*Primary Examiner*—Stephen P. Garbe
*Attorney, Agent, or Firm*—Frommer Lawrence & Haug LLP

[57] ABSTRACT

A blank for use in making an envelope has areas 6, 7 and 8 for forming a front panel, a rear panel and an intermediate panel of the envelope. The area 6 is formed with a window 20 through which an address, on the area 8, for a second use of the envelope can be seen. In a first use of the envelope, a piece of paper bearing an address for the first mailing is interposed between the window and the area 8, whereby the address thereon is obscured and the address on the piece of paper can be seen through the window 20. At one end of one of the areas 6 and 7, there is joined to that area, along a line of weakness 21, a tear-off strip 11 and at the corresponding end of the other of the areas 6 and 7 there is joined to that area, but not along a line of substantial weakness, a fold-over area 10 which can be used to seal the envelope, for its second use, after the tear-off strip 11 has been removed. In some examples a sheet of transparent material is stuck by adhesive 14 to the area 7, covering the window, the sheet having a second line of weakness which lies along the first line of weakness 21. The sheet has a major portion joined along the second line of weakness to a minor portion which is stuck by adhesive to the tear-off strip 11 so that it comes off the envelope therewith.

2 Claims, 6 Drawing Sheets

ENVELOPE

This application is a continuation of application Ser. No. 08/681,608, filed Jul. 29, 1996, now abandoned, which is a continuation of Ser. No. 08/543,494, filed Oct. 16, 1995, now abandoned, which is a continuation of Ser. No. 08/211,096, filed Mar. 18, 1994, now abandoned.

FIELD OF THE INVENTION

This invention relates to a blank, referred to below as "a blank of the kind defined", which is suitable for use in making an envelope, the blank having first and second areas for forming a front panel and a rear panel, respectively, of the envelope, each area having first and second opposite sides and third and fourth opposite sides, a third area for positioning between the front and rear panels by suitably folding the blank, a tear-off strip joined to one of the first and second areas along a line of weakness, whereby tearing off the tear-off strip, after a first use of the envelope, opens the envelope, after which the envelope may be sealed for a second use using a fold-over area of the blank.

This invention also relates to an envelope, referred to below as "an envelope of the kind defined", comprising a front panel and a rear panel, each having first and second opposite sides and third and fourth opposite sides, a third panel between the front and rear panels, a tear-off strip joined to one of the front and rear panels along a line of weakness, whereby tearing off the tear-off strip, after a first use of the envelope, opens the envelope, after which the envelope may be sealed for a second use, using a fold-over area of the envelope.

BACKGROUND OF THE INVENTION

A blank of the kind defined and an envelope of the kind defined are disclosed in United Kingdom Patent Specification No. 2,117,319A. Here the line of weakness is one of at least three lines of weakness, two of which are parallel to one another at the first and second sides of one of the first and second areas of the blank, or at the first and second sides of one of the front and rear panels of the envelope. The third line of weakness is perpendicular to the other two and extends to meet both of them by extending across the first area or the second area of the blank, or across the front panel or the rear panel of the envelope, so as to divide the area or panel concerned into a major portion and a minor portion, of which the latter provides the fold-over area which can be used to seal what remains of the envelope after the recipient in the case of the first use has torn along all three lines of weakness and removed two narrow tear-off strips and said major portion.

Having at least three lines of weakness, of which the third extends across the front panel or the rear panel when the envelope is used for the first time, makes the envelope liable to damage during its first use and likely to be wrongly handled by the recipient.

U.K. Patent Specification No. 212,712 discloses a somewhat similar blank and envelope in which a tear-off strip is joined along a line of weakness to one of the sides of the first area of the blank (i.e. the front panel of the envelope) and there is a second line of weakness, laterally spaced from the first line of weakness and parallel to it and to the sides of the first area (i.e. the front panel) separating the tear-off strip from a stick-on strip. The latter strip is stuck to the rear panel, sealing the envelope, before the envelope is mailed in its first use and stays in position for the second use of the envelope. Centrally between the two lines of weakness and parallel to them there is a fold in the tear-off strip and this forms the upper edge of the envelope during its first use. One line of weakness lies on the other and this facilitates tearing off the tear-off strip by the recipient after the first use of the envelope. The recipient then pulls the third area (i.e. the third panel) out of the envelope and, after putting something in the envelope, seals the envelope by sticking the third area (third panel) to the first area (front panel), thus obscuring the address previously placed there for the first use of the envelope. The fold-over area mentioned above is joined to one end of the first area (front panel) and a similar fold-over area is joined to the other end thereof. These areas are stuck to the second area (rear panel) before the first use of the envelope and remain stuck to it.

A disadvantage of the envelope disclosed in U.K. Patent Specification No. 212,712 is that the recipient of the envelope after its first use must pull the third panel out of it, with the possibility of tearing the envelope.

SUMMARY OF THE INVENTION

According to the invention a blank suitable for use in making an envelope comprises first and second contiguous substantially rectangular areas for folding over one upon the other to form front and rear envelope panels respectively, a third area contiguous with one of the first and second areas for folding between the front and rear panels for dividing the interior of the envelope into front and rear pockets, a window in the first rectangular area exposing a portion of the third area through the front envelope panel, the portion of the third area having a printed address visible through the window when the front envelope pocket is empty, a tear-off strip joined along one side of one of the first and second rectangular areas along a line of weakness, a fold-over closure flap joined along one side of the other of the first and second rectangular areas whereby when the first and second rectangular areas are folded to form the front and rear envelope panels the tear-off strip and the closure flap are brought to lie one over the other, and a sheet of material secured face-to-face to the other rectangular area and having a tear-off portion extending beyond the one side thereof so as to be positioned between the tear-off strip and the closure flap, the tear-off portion of the sheet being joined by a further line of weakness to the portion of the sheet secured to the other rectangular area, whereby the edge of the envelope bearing the tear-off portion, the tear-off strip and the closure flap may be closed for a first use of the envelope by securing the tear-off portion to the tear-off strip, thereafter opened by removing both the tear-off portion and the tear-off strip, and then re-closed for a second use of the envelope by folding over the closure flap and securing it to the one rectangular area.

Preferably the sheet of material is secured to the first rectangular area, is transparent, and covers the window in the first rectangular area.

The invention further provides an envelope comprising front and rear panels, a third panel between the front and rear panels for dividing the interior of the envelope into front and rear pockets, a window in the front panel exposing a portion of the third panel, the portion of the third panel having a printed address visible through the window when the front envelope pocket is empty, a tear-off strip joined along one side of one of the front and rear panels along a line of weakness, a fold-over closure flap joined along the corresponding side of the other of the front and rear panels so that the tear-off strip and the closure flap lie one over the other, and a sheet of material secured face-to-face to the other panel and having a tear-off portion extending beyond the one side thereof so as to be positioned between the tear-off strip and the closure flap, the tear-off portion of the sheet being joined by a further line of weakness to the portion of the sheet secured to the other panel, whereby the edge of the envelope bearing the tear-off portion, the tear-off strip and the closure flap may be closed for a first use of the envelope by securing the tear-off portion to the tear-off strip, thereafter opened by removing both the tear-off portion and the tear-off strip, and then re-closed for a second use of the envelope by folding over the closure flap and securing it to said one panel.

BRIEF DESCRIPTION OF THE DRAWINGS

Several examples in accordance with the present invention are described below with reference to the accompanying drawings, in which.

DETAILED DESCRIPTION OF CERTAIN PREFERRED EMBODIMENTS

Figure 1:
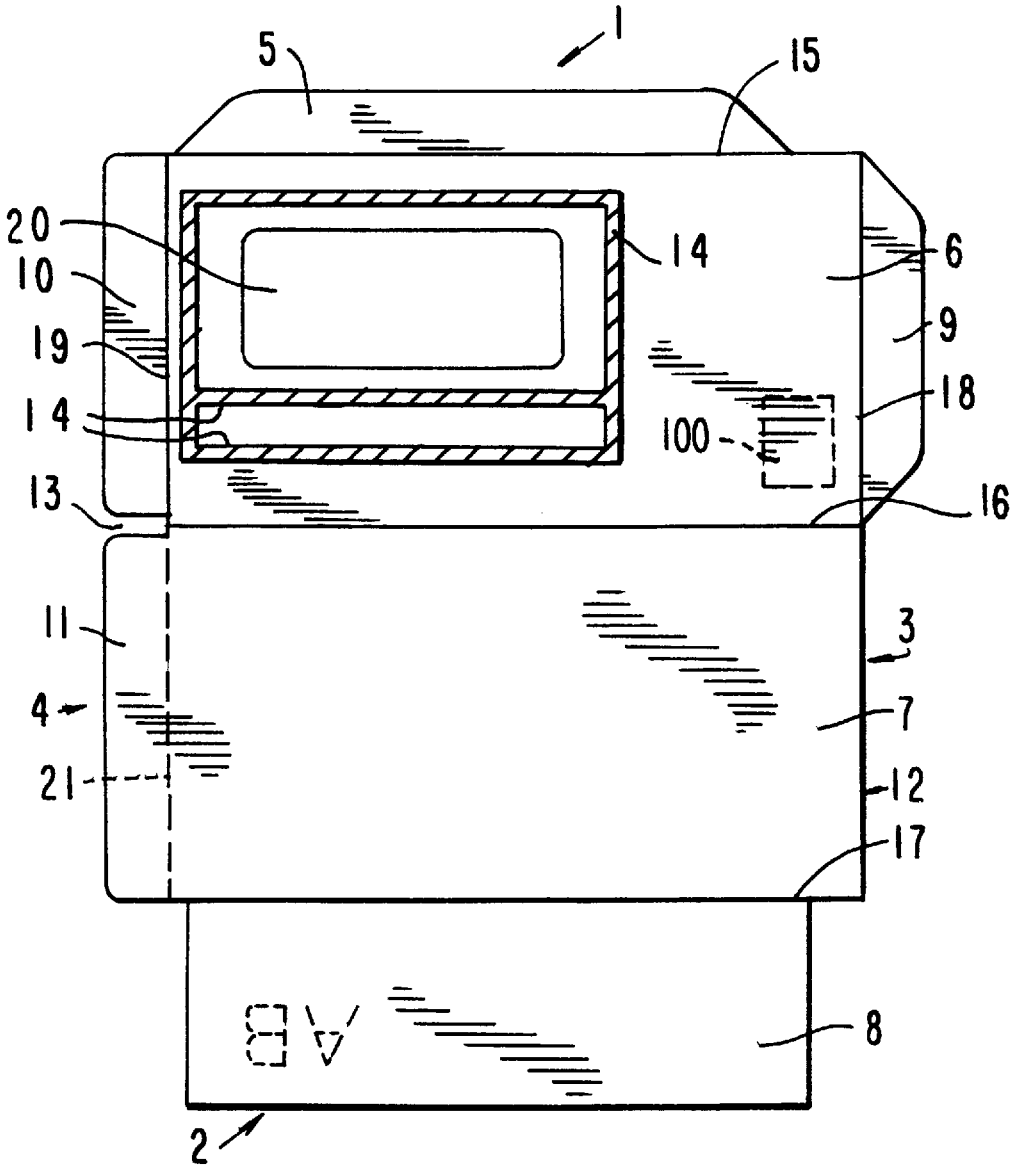
FIG. 1 shows a paper blank which can be used to make an envelope.

The blank 12 shown in FIG. 1 is opaque or, at least, much less transparent than the transparent sheet mentioned below. The blank is elongate and generally rectangular and thus has first and second opposite ends 1 and 2 and first and second opposite sides 3 and 4. Proceeding from the end 1 to the end 2, the blank comprises a first closure flap 5 and first, second and third rectangular panel-forming areas, 6, 7 and 8, respectively, which form a front panel, a rear panel and a third panel, respectively, of the envelope. The first area 6 has sides, denoted by lines 15 and 16, which are much closer together than its ends, denoted by lines 18 and 19, and the second area 7 has sides, denoted by lines 16 and 17, which are much closer than its ends, one of which is denoted by a line 21.

On the first side of the blank there is a second closure flap 9 which is contiguous with the first panel-forming area 6. On the second side of the blank there are a fold-over area 10 and a tear-off strip 11 which are contiguous with the first and second panel-forming areas 6 and 7, respectively, and which are connected to one another only by the areas 6 and 7 because a portion has been cut out, leaving a gap 13 between the parts 10 and 11. There could instead be a horizontal slit here. Lines 15 to 19 indicate the divisions between the parts 5 and 6, 6 and 7, 7 and 8, 6 and 9, and 6 and 10, respectively, and places where the paper should be folded. Fold lines may be printed on the paper at these places or omitted entirely so that the lines 15 to 19 are merely notional, and do not appear on the blank, before the blank is folded. A window 20 is formed in the area 6.

A straight line of substantial weakness 21, formed by perforating the paper, for example, extends in the direction from the line 16 to the line 17 of the blank, i.e. perpendicular to the lines 15, 16 and 17 and parallel to the lines 18 and 19. The line of weakness 21 is at the junction between the area 7 and the closure portion 11. There is no such line of perforations or other form of likewise substantial weakness at the junction between the area 6 and the fold-over area 10, i.e. line 19 is not a line of weakness in the blank before it is folded. In other words, the join between parts 6 and 10 could be described as robust, much more robust than the join between parts 7 and 11. The blank is to be used to make an envelope, as described below, which is to be sent to a first addressee and later, by that addressee, to a second addressee, possibly the original sender. The second addressee's name and address AB are printed upside-down, considering FIG. 1, on the area 8, on the non-exposed or lower face of the blank, i.e. the face which cannot be seen in FIG. 1, at a position where it can be seen through the window 20 when the blank is folded as described below. There is further upside-down printing on the same (non-exposed) face of the areas 6 and 7 and the closure flap 5. This printing may include a postage license or a rectangle 100 indicating where an adhesive postage stamp or franking should be applied, the postage licence or rectangle being on the area 6 near the lower end of the flap 9.

Figure 2:
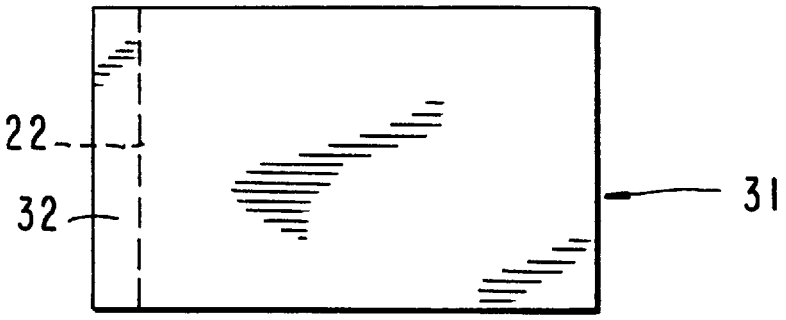
FIG. 2 shows a transparent sheet which can be secured to the blank.

FIG. 2 shows a thin transparent sheet 31 which is to be placed on the exposed face (considering FIG. 1) of the blank shown in FIG. 1. It has a straight line 22 of weakness, for example perforations, near one edge. The sheet 31 covers the window 20 and parts of the area 6 immediately surrounding the window and it is stuck to those parts by adhesive 14 on the blank and completely surrounding the window. The adhesive could instead initially be on the sheet 31. The line 22 of weakness lies on the line 19 and is spaced by about 2 to 5 mm. from the nearest part of the adhesive sticking the sheet 31 to the blank 12.

Figure 9:
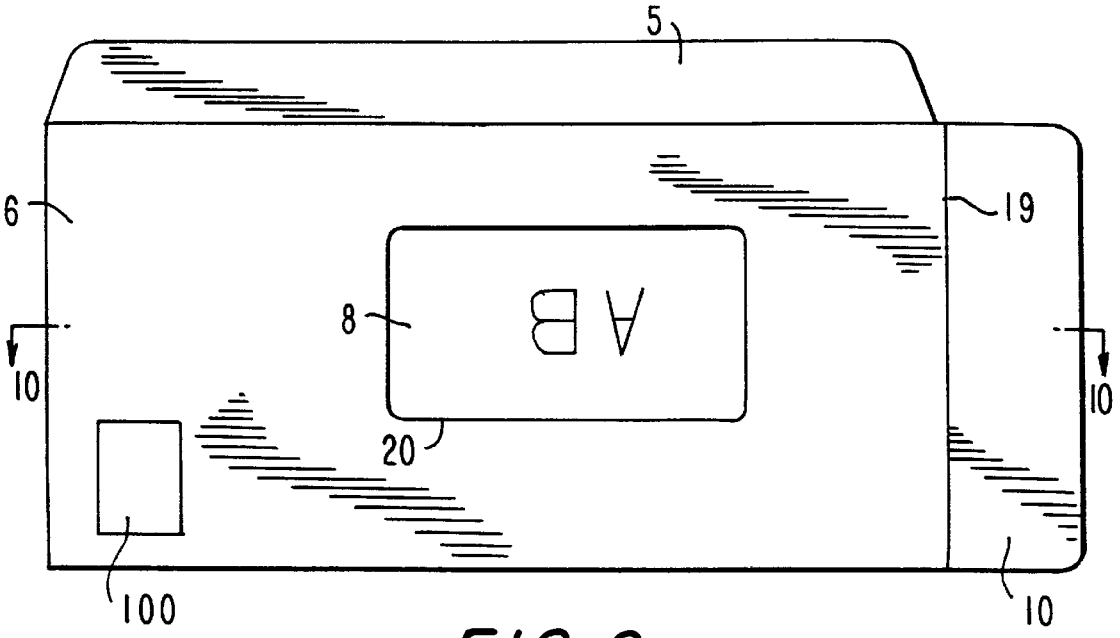
FIG. 9 shows the blank of FIG. 1 folded into an envelope ready for first use.
Figure 10:
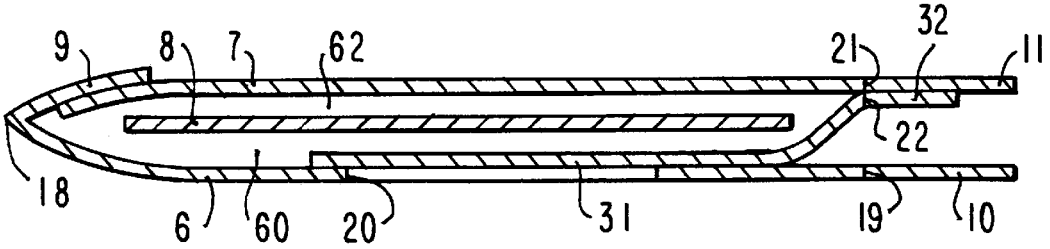
FIG. 10 is a cross-section taken along line X—X of FIG. 9 with the thickness of the various layers greatly exaggerated for clarity.

To form the assembly of the blank 12 and the sheet 31 into the envelope, firstly the paper is folded about the line 17 so that the end 2 lies well below the line 16. Then the paper is folded about the line 16 to bring the line 17 just below the line 15. One of the lines 21 and 22 of weakness now lies on the other one. Then the paper is folded about the line 18 and the closure flap 9 is secured by adhesive (not shown), on the closure flap 9 or on the area 7, to the outer face of the rear panel formed by the area 7. The area 6 now forms a front panel of the envelope and the area 8 forms an intermediate panel. A front pocket 60, FIG. 10, to receive at least one item, is formed between the front panel and the intermediate panel and a rear pocket, to receive at least one item, is formed between the rear panel and the intermediate panel both these pockets are closed at both narrow ends; i.e. at the left hand end (as seen in FIGS. 9 and 10) by the flap 9 and at the right hand end by adhesive (not shown) on the tear-off strip 11 or on the sheet 31 which secures the minor portion 32 of the sheet 31 to the tear-off strip 11. The sheet 31 covers on about half the width of the tear-off strip 11. The front pocket is still open because the closure flap 5 along the top edge of the envelope has not yet been stuck down.

Figure 11:
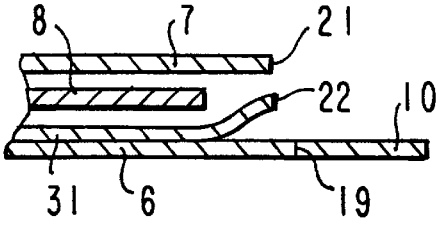
FIG. 11 shows the right hand end of FIG. 10 after the envelope has been opened after first use.
Figure 12:
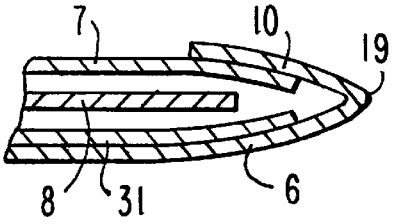
FIG. 12 shows the right hand end of FIG. 10 after the envelope has been re-closed for second use.

The envelope is sold in the condition seen in FIGS. 9 and 10. The purchaser inserts one item, bearing the name and address of the first addressee, in the front pocket 60 through the opening at the flap 5, possibly with at least one item behind it, with the name and address of the first addressee being visible through the window 20 and obscuring the second addressee AB. Then the front pocket is closed by sticking the closure flap 5 to the rear panel using adhesive (not shown) on the closure flap 5 or on the rear panel. The envelope and its contents are mailed to the first addressee, who tears off the parts 11 and 32 by tearing along the lines of weakness 21 and 22, which opens both pockets at one end (FIG. 11). The first addressee removes the contents of the front pocket and inserts at least one item in the rear pocket. Then the paper is folded about the line 19 and adhesive (not shown) on the fold-over area 10 is used to close both pockets, by applying the fold-over area 10 to the end of the area 7 (FIG. 12). The adhesive could be on the area 7 instead of on the area 10. The second addressee's name and address AB now appears through the window and the envelope and its contents may now be mailed to the second addressee.

Figure 3:
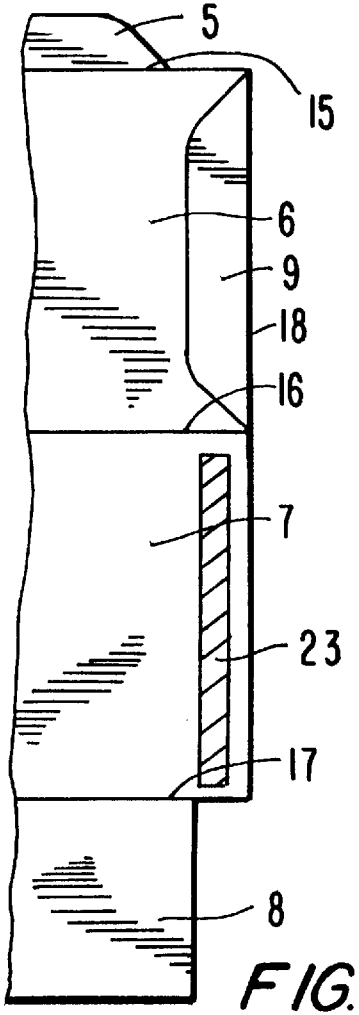
FIG. 3 shows a modification of the blank shown in FIG. 1.

FIG. 3 shows a possible modification of the first side 3 of the blank shown in FIG. 1, the modification consisting in a line of adhesive 23 on the area 7, on that face thereof which can be seen in FIGS. 1 and 3. Instead of this adhesive 23 being on the area 7, it could be on the opposite face of the closure flap 9. Before the paper is folded about the line 16, and if desired also before it is folded about the line 17, it is folded about the line 18 so that the closure flap overlies the area 6, as shown in FIG. 3. Then in the folding of the paper about the line 16, after folding it about the line 17, the adhesive 23 secures the inner face of the rear panel to the closure flap 9.

With the adhesive 23 present as shown in FIG. 3, it is possible to omit the closure flap 9 so that the adhesive 23 sticks the front and rear panels directly together. If the closure flap 9 is omitted, the adhesive could be on the area 6 instead of on the area 7.

In both the example shown in FIGS. 1 and 2 and the modification shown in FIG. 3, the tear-off strip 11 could be of a colour contrasting to that of the remainder of the envelope and it could bear a legend such as "TO OPEN—remove this coloured portion only", on the same face of the blank as the other printed matter mentioned above. The fold-over area 10 could bear instructions on either face about how to insert into the envelope the item or items intended for the second addressee and/or instructions about how to re-seal the envelope.

Figure 5:
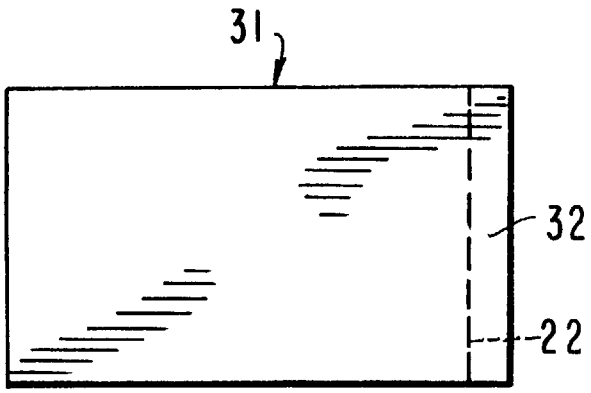
FIGS. 4 and 5 show views, corresponding to those of FIGS. 1 and 2, of a third blank and a transparent sheet.
Figure 4:
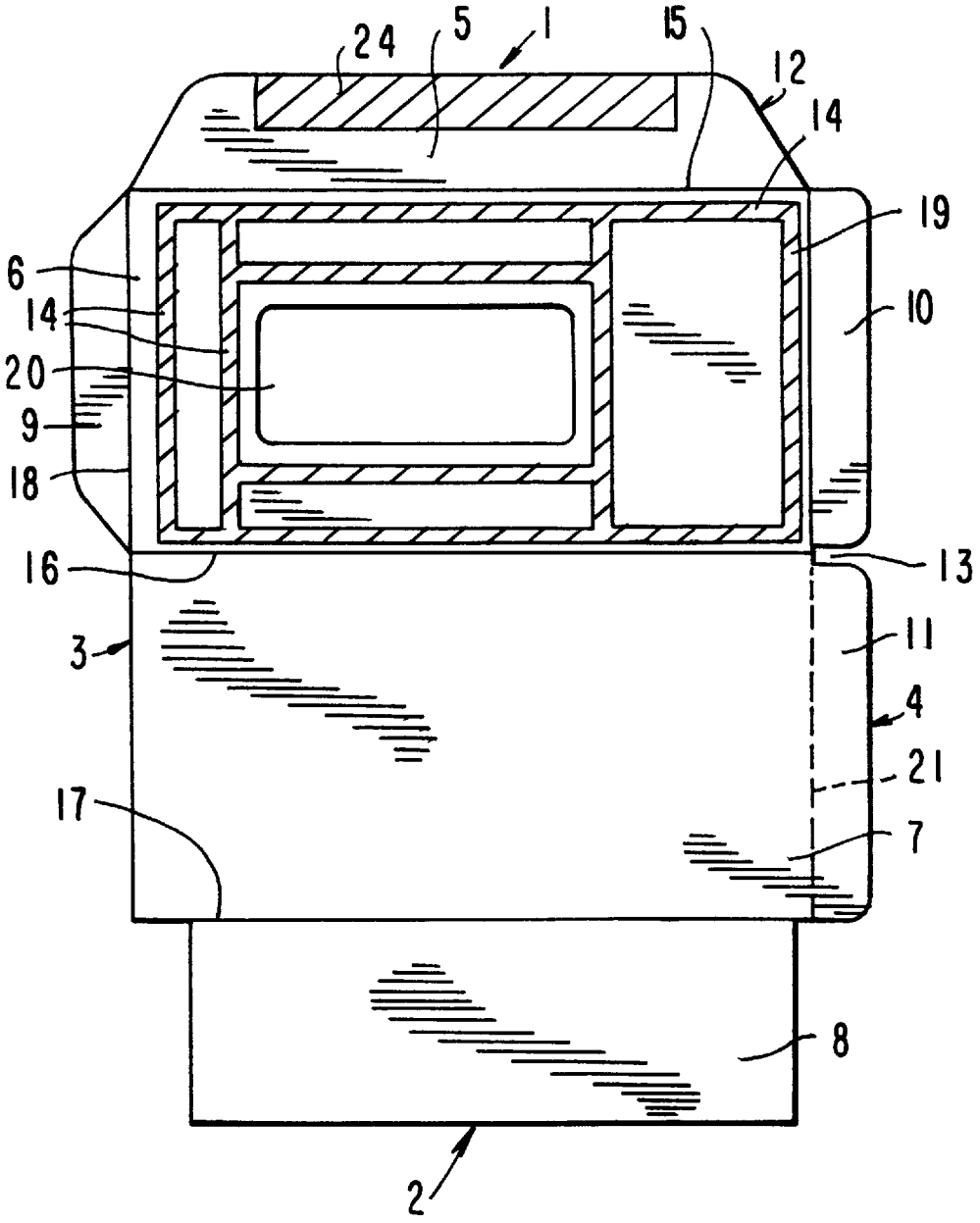

In the example shown in FIGS. 4 and 5 the first side 3 is on the left instead of on the right when viewing the face of the blank which forms the inner faces of the front and rear panels, with the area 6 containing the window 20 above the area 7. The numbers 1 to 22, 31 and 32 have the same significance as in FIGS. 1 and 2. Here the window 20 is more nearly central in the area 6 and there is a more extensive and more complex pattern of adhesive 14 around it. The closure flap 5 has a greater width, measured vertically in FIG. 4, than is the case with the blank shown in FIG. 1 and it bears on only part of its area an adhesive 24 on the face which can be seen in FIG. 4. Adhesive on the flap 9 or on the hidden face of the area 7 could be replaced by adhesive 23 on the exposed face of the area 7, as shown in FIG. 3, and again the closure flap 9 could be omitted.

Preferably, all the required adhesive is initially applied to one face only of the blank.

Figure 6:
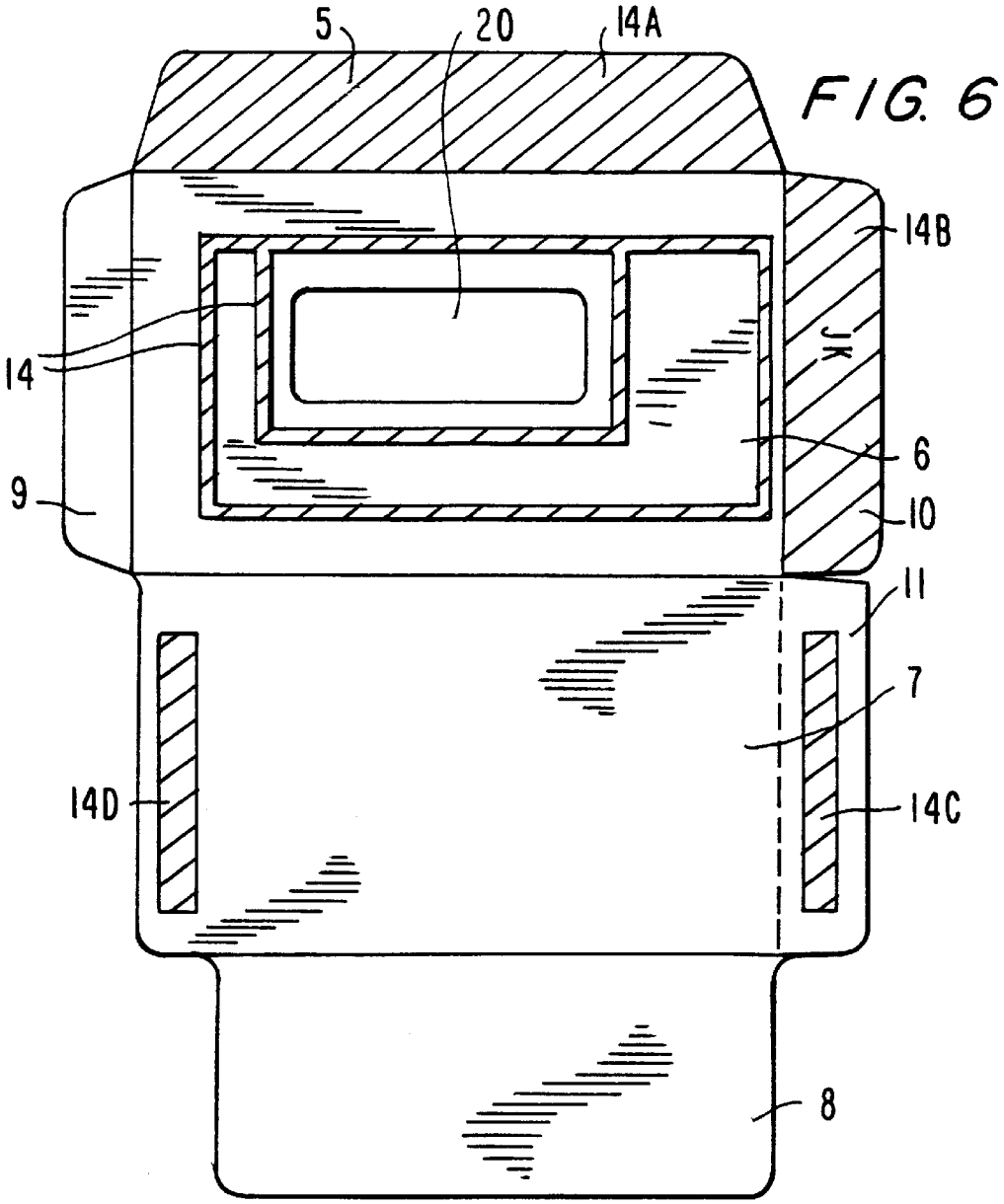
FIG. 6 shows one face of a fourth blank.
Figure 7:
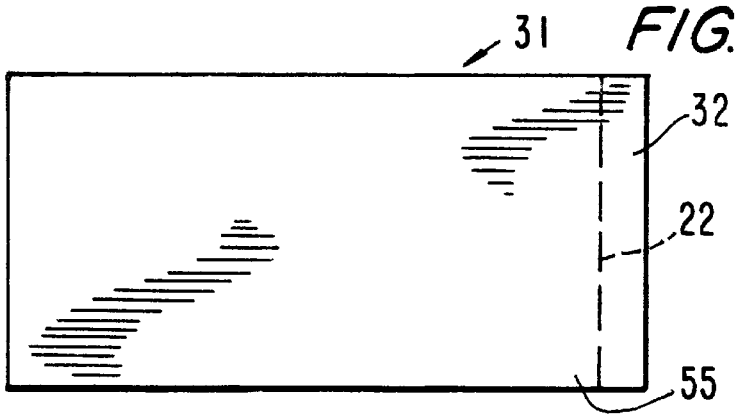
FIG. 7 shows a transparent sheet which is to be secured to the fourth blank.
Figure 8:
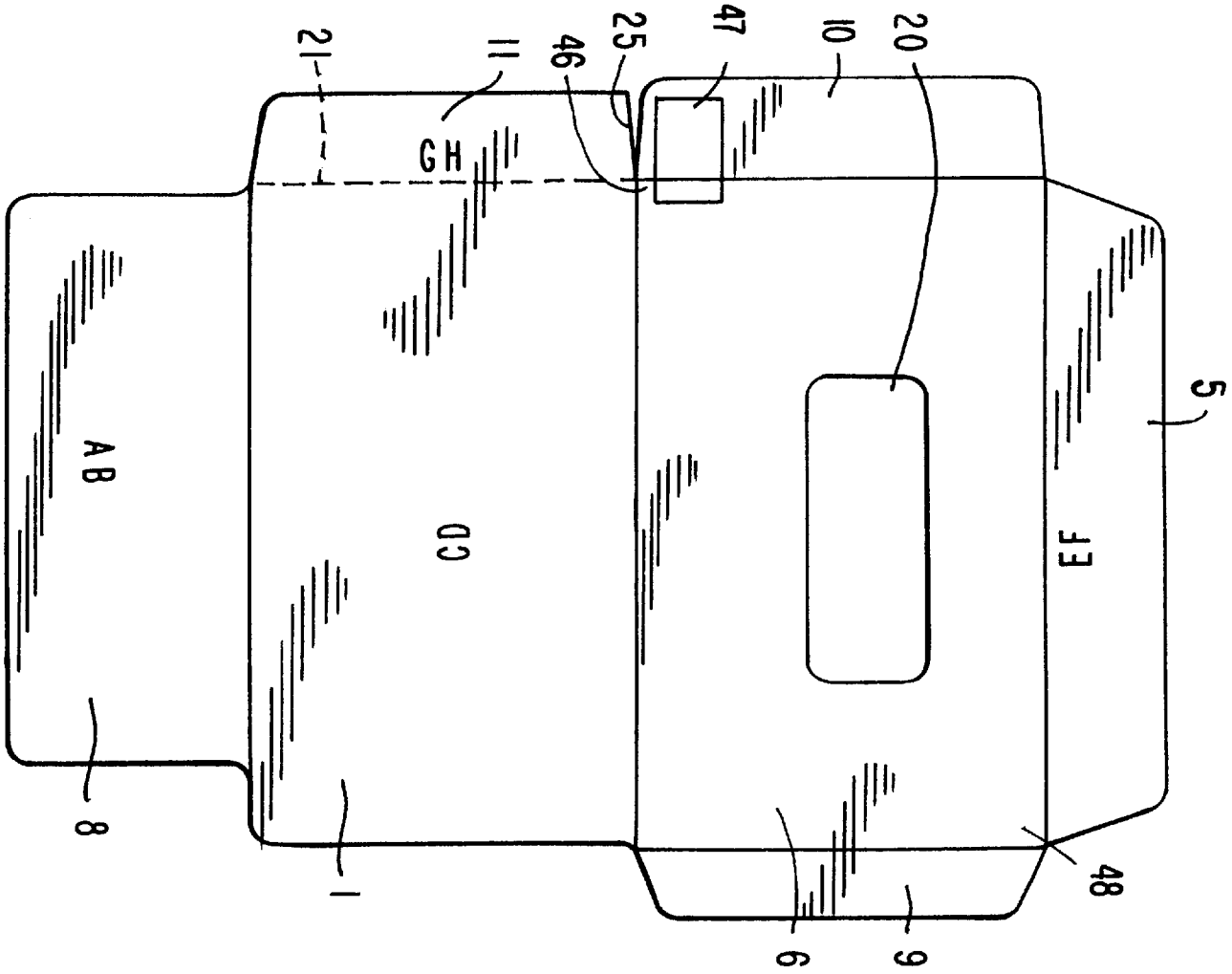
FIG. 8 shows the opposite face of the fourth blank.

FIGS. 6 and 8 show those faces of the fourth blank which are destined to provide the inside faces and the outside faces, respectively, of the front and rear faces of the envelope. The blank is similar to that shown in FIG. 4 and similar references have the same significance in both cases. There is a slit 25 between the parts 10 and 11. The pattern of the adhesive 14 is different, the flap 5 is covered all over one face with adhesive 14A, the fold-over area 10 is covered all over one face with adhesive 14B, the tear-off strip 11 has on one face a narrow band 14C of adhesive. Near the end of the area 7 further from the strip 11 there is a narrow band 14D of adhesive on one face which engages the opposite face of the flap 9 after the blank has been folded to bring the area 8 into contact with the area 7 and then folded to bring the flap 9 into contact with the area 6. The flap 9 is not wide enough to contact the major portion 55 of the sheet 31, which has previously been stuck to the front panel 6 by the adhesive 14. The last folding of the blank brings the adhesive 14D into contact with the flap 9 and the adhesive 14C into contact with the minor portion 32 of the sheet 31.

FIGS. 6 and 8 show the orientations of printing on the blank, i.e. AB, upright on area 8, being the name and address of the addressee for the second use of the envelope, CD upside-down on the area 7, being advertising material, EF, upside-down on the flap 9, being a warning to open the envelope carefully at the end where the parts 10 and 11 are situated, GH, informing the first addressee that the tear-off strip 11 should be bent and torn along the line of weakness to open the envelope, all this being on one face of the blank, and, on the opposite face, GH, instructing the recipient to insert a cheque and a payment slip between the panels 7 and 8, so that the material AB can be seen through the window 20, and moisten the area 10 and apply it to the rear panel 7; part of the area 10 will be applied to the flap 9, which still seals the lower side of the envelope.

An important difference between the blank of FIGS. 6 and 8 and that of FIG. 4 is that adjacent one corner 46 of the area 6, on the face which is free from adhesive, there is a postage licence or postage stamp 47, which is partly on the fold-over area 10 and partly on the area 6, although it could be wholly on the area 10. When the fold-over area 10 is folded over and stuck to the rear panel, little or none of the postage licence or stamp 47 remains on the front face of the envelope, so that postal staff are unlikely to be confused by it. The first addressee can apply a postage stamp or franking near the diagonally opposite corner 48 of the front panel. He could be assisted in realising that this is required of him by the printing of a rectangle near the corner 48, in case the upright nature of the material AB when the flap 5 is at the top of the letter does not make him realise what is required.

The postage licence or stamp 47 could be near the corner 46 but wholly on the area 6, so that it remains wholly on the front panel of the envelope when the area 10 is applied to the rear panel; then, however, it might be necessary to stick a piece of paper over it or strike it out with ink.

All the adhesive is preferably on one face only of the blank and nearly all the printing on the opposite face, of which parts form the outside surfaces of front and rear panels 6 and 7 of the envelope, the sole exception being printing on the fold-over area 10.

I claim:

1. A blank suitable for use in making an envelope, comprising first and second contiguous substantially rectangular areas for folding over one upon the other to form front and rear envelope panels respectively, a third area contiguous with one of said first and second areas for folding between the front and rear panels for dividing the interior of the envelope into front and rear pockets, a window in the first rectangular area for exposing a portion of the third area through the front envelope panel, the portion of the third area having a printed address visible through the window when the front envelope pocket is empty, a tear-off strip joined along one side of said second rectangular area along a line of weakness, a fold-over closure flap joined along the corresponding side of said first rectangular area whereby when the first and second rectangular areas are folded to form the front and rear envelope panels, the tear-off strip and the closure flap are brought to lie one over the other, and a transparent sheet of material secured face-to-face to said first rectangular area and covering the window, the sheet of material having a tear-off portion extending beyond said one side of said first rectangular area so as to be positioned between the tear-off strip and the closure flap, the tear-off portion of the sheet being joined by a further line of weakness to the portion of the sheet secured to said first rectangular area, whereby the edge of the envelope bearing said tear-off portion, said tear-off strip and said closure flap may be closed for a first use of the envelope by securing said tear-off portion to said tear-off strip, thereafter opened by removing both said tear-off portion and said tear-off strip, and then re-closed for a second use of the envelope by folding over the closure flap and securing it to said second rectangular area.

2. An envelope comprising front and rear panels, a third panel between the front and rear panels for dividing the interior of the envelope into front and rear pockets, a window in the front panel for exposing a portion of the third panel, the portion of the third panel having a printed address visible through the window when the front envelope pocket is empty, a tear-off strip joined along one side of said rear panel along a line of weakness, a fold-over closure flap joined along the corresponding side of said front panel so that the tear-off strip and the closure flap lie one over the other, and a transparent sheet of material secured face-to-face to said front panel and covering the window, the sheet of material having a tear-off portion extending beyond said one side of said front panel so as to be positioned between the tear-off strip and the closure flap, the tear-off portion of the sheet being joined by a further line of weakness to the portion of the sheet secured to said front panel, whereby the edge of the envelope bearing said tear-off portion, said tear-off strip and said closure flap may be closed for a first use of the envelope by securing said tear-off portion to said tear-off strip, thereafter opened by removing both said tear-off portion and tear-off strip, and then re-closed for a second use of the envelope by folding over the closure flap and securing it to said rear panel.

* * * * *

UNITED STATES PATENT AND TRADEMARK OFFICE

CERTIFICATE OF CORRECTION

PATENT NO. : 5,823,423
DATED : October 20, 1998
INVENTOR(S) : Murray

It is certified that error appears in the above-identified patent and that said Letters Patent is hereby corrected as shown below:

Title page, item [30], add the followings: Sept. 22, 1992 PCT.....IE92/00011.

Title page, item [30], change the application number filed April 15, 1992 from "921213 to --9212131--.

Signed and Sealed this

Ninth Day of March, 1999

*Attest:*

Q. TODD DICKINSON

*Attesting Officer*

*Acting Commissioner of Patents and Trademarks*